US007808359B2

(12) United States Patent
Rao

(10) Patent No.: US 7,808,359 B2
(45) Date of Patent: Oct. 5, 2010

(54) QUAD-GAPPED TOROIDAL INDUCTOR

(76) Inventor: Dantam K. Rao, 2212 Lynnwood Dr., Schenectady, NY (US) 12309

( * ) Notice: Subject to any disclaimer, the term of this patent is extended or adjusted under 35 U.S.C. 154(b) by 258 days.

(21) Appl. No.: 11/254,758

(22) Filed: Oct. 21, 2005

(65) Prior Publication Data

US 2007/0090916 A1 Apr. 26, 2007

(51) Int. Cl.
*H01F 27/28* (2006.01)

(52) U.S. Cl. ..... 336/229; 336/178

(58) Field of Classification Search ..... 336/229
See application file for complete search history.

(56) References Cited

U.S. PATENT DOCUMENTS 3,102,245 A * 8/1963 Lawson, Jr. ..... 336/84 R
3,633,272 A 1/1972 Benke
4,199,744 A 4/1980 Aldridge et al.
4,779,070 A * 10/1988 Hackworth et al. ..... 335/296
4,975,672 A 12/1990 McLayman
5,165,162 A * 11/1992 Charles ..... 29/605
5,396,212 A 3/1995 Hernandez et al.
6,492,893 B2 12/2002 DeGraff
6,531,946 B2 3/2003 Abe et al.
6,762,666 B2 7/2004 Chu

FOREIGN PATENT DOCUMENTS

WO WO9215103 A * 4/1992

* cited by examiner

*Primary Examiner*—Elvin G Enad
*Assistant Examiner*—Joselito Baisa
(74) *Attorney, Agent, or Firm*—Clyde I. Coughenour

(57) ABSTRACT

A high power, high frequency toroidal inductor is broken into four quadrant cores and uses bare rectangular conductors to form coils. One coil is wound centrally around each quadrant. The coils positioned centrally on the quadrants minimize the effect of damaging fringe flux and leakage flux. The coil inner winding ends are bent perpendicular to the coils to form tangential leads with one coil inner tangential lead joined to an adjacent outer coil radial lead by jumpers that span adjacent coils.

11 Claims, 4 Drawing Sheets

QUAD-GAPPED TOROIDAL INDUCTOR

STATEMENT OF GOVERNMENT INTEREST

The United States Government has certain rights in this invention. This invention was made with Government support under Contract Number N00014-04-C-0288 awarded by the Department of the Navy.

BACKGROUND OF THE INVENTION

1. Field of the Invention

The invention is to a high power, high frequency toroidal inductor with the core in segments with centrally located coils that produces lower losses, operates cooler, is more compact and lighter in weight.

2. Description of Related Art

A typical inductor consists of a coil, that creates flux, a magnetic core, that directs flux, and an air gap, that stores magnetic energy. The air gap is made of two flat faces of iron within the magnetic core.

Prior art magnet wires have limited use in making coil loops that carry large currents. The problem is exacerbated by the difficulty in transferring the heat produced by the wire into the air. Above 200 amps the design of the inductor is dictated more by thermal issues than by inductance issues.

Large currents can be carried by rectangular sectioned copper conductors that are pre-insulated by coating. Such insulated conductors are called magnet wire. When the magnet wire is wound around a toroidal core, it has to be bent 90 degrees four times in order to make one complete loop. When the magnet wire is thicker than 0.125 inch, it becomes difficult to sharply bend magnet wire without damaging the insulation coating. Bending a thick magnet wire with sharp radius will bend the insulation coating also. During bending, the inner insulation coating layer gets compressed, while the outer insulation layer gets stretched. The stretching and compression introduce very large stresses in the insulating layer. The polymeric materials, usually used, are not as strong as metals and their ability to stretch or compress is extremely limited and their tensile strengths are extremely low when compared to that of copper. While the copper conductor can deform and bend sharply, the insulation coating cannot stretch in the same way without cracking. A sharp bending will stretch the insulation coatings so severely that they crack.

Hernandez et al, U.S. Pat. No. 5,396,212, issued 7 Mar. 1995, addresses wire bending and shapes that produce the best electrical characteristics. F. Benke, U.S. Pat. No. 3,633,272, issued 11 Jan. 1972, addresses conductor thickness and width for insulation. Abe et al, U.S. Pat. No. 6,531,946, issued 11 Mar. 2003, addresses high frequency effect and the effect of various gaps in toroidal cores.

When the coils are energized, magnetic flux lines are concentrated through the cores. Most of such flux lines flow through iron, and whenever there is an air gap, they jump across the air gaps, perpendicular to the flat faces of iron that form the air gap. The air gap in a typical inductor can be as small as 0.010 inch or as large as 0.062 inch. Large air gapped inductors are not preferred as they emit significantly more fringe fields that generate harmful electromagnetic interference and heat up any nearby copper conductors.

Any part of flux lines where relative permeability equals 1 is called an "air gap." Air gaps can be of two types. One, that is usually called the magnetic gap, is formed by flat iron faces that are narrow. Another, usually called fringe gap, is formed by curved iron faces with flux lines that extend outwardly perpendicular from one iron section, bend around an iron-to-iron gap, and extend perpendicular back into the adjacent iron section. A small portion of flux, called fringing flux, emanates from one iron face and jumps by way of the fringe gap into the nearest iron face.

Some of the fringe flux lines may penetrate a copper conductor in their path. Such flux lines, when changing rapidly, create a voltage that induces eddy currents in the copper in accordance with the Lenz law. These eddy currents create so-called fringe losses within the conductor. The fringe loss is especially severe at higher frequencies of 1 kHz and above. Modem pulse-width-modulated power converters produce such flux levels at higher frequencies. The fringe loss increases with the square of the frequency and flux density.

Magnetic gaps are introduced into the inductor by slitting the toroidal core. Some inductors used a single air-gap, M. DeGraff, U.S. Pat. No. 6,492,893, issued 10 Dec. 2002 and R. Chu, U.S. Pat. No. 6,762,666, issued 13 Jul. 2004, being examples. High power inductors require large amounts of energy to be stored. When large amounts of energy are stored in a single magnetic gap, it is found that significantly more energy dissipation occurs. One approach to reduce eddy loss breaks up a magnetic gap into several small air gaps. This can reduce the amount of energy that is dissipated. Multiple air-gapped toroids are proposed by Aldridge et al, U.S. Pat. No. 4,199,744, issued 22 Apr. 1980 and R. Charles, U.S. Pat. No. 5,165,162, issued 24 Nov. 1992.

Even though multiple air gaps can be used to reduce heat dissipation, prior art inductors made no deliberate attempt to prevent fringing flux lines from penetrating the coil windings.

A second approach relies on using Litz wire to self-cancel the eddy currents, a described in W. T. McLayman, U.S. Pat. No. 4,975,672, issued 4 Dec. 1990. The air gap made of two flat faces of iron is also exemplified by W. T. McLayman. Litz wire capable of carrying hundreds of amps is very large. Such large Litz wire is heavy, voluminous, costly and has poor life.

Bending large Litz diameter wires over sharp bending angles or small bend radius greatly increases bending stress in the insulation coating on the wire. After sustained operation over a long time, excessive stress damages the insulation coating. Even in a simple AWG2 magnet wire (with diameter of approximately 0.5 in.), if bent at 90 degrees, the insulation will crack and fail. One objective is to avoid this life-degradation, cost and weight penalties.

Because the Litz wire's copper fill factor is very low, it occupies more space than conventional copper conductors, thereby increasing the overall inductor volume. Copper fill factor is defined as the ratio of copper area and the geometrical winding window of the inductor. Larger diameter Litz wires increase the size of the coil. It also greatly increases the volume of the inductor since the wire occupies more space around it. The net result is that the Litz wire-based high power inductors tend to be extremely heavy and large.

SUMMARY OF THE INVENTION

The present invention reduces the size and weight of the inductor. The fringe losses are reduced by increasing the number of core sections separated by air gaps. The coil windings are placed centrally within the core sections using rectangular conductors wound bare and later insulated to reduce flux leakage and minimize damaging fringe flux. The coil ends are joined by jumpers that conduct electricity between the coils.

DESCRIPTION OF THE PREFERRED EMBODIMENTS

The invention relates to high power inductors made of a toroidal magnetic core energized by conductor coil windings which surround the core. The result is a novel high power, high frequency toroidal inductor that is cooler, produces lower losses, lasts longer, is compact and light weight. The inductor core is broken into 4 quadrants, and uses bare rectangular conductor wires wound around each quadrant. The conductor coils are positioned to minimize the effect of damaging fringe fluxes and leakage fluxes. This results in minimal loss in the inductor. As a result the life of the inductor is increased.

The inductors of interest carry large currents, typically above 100 A. The thickness of the conductors to carry such a large current usually ranges from 0.1 to 0.5 in. The width is also of a similar range, but it is always much wider than the thickness.

Even though many shape cores are available, the core shape of interest is toroidal. The toroidal core is formed either by winding a thin strip of magnetic material continuously, like a tape, or by using powder iron that is pressed and compacted into toroidal shape.

Figure 1:
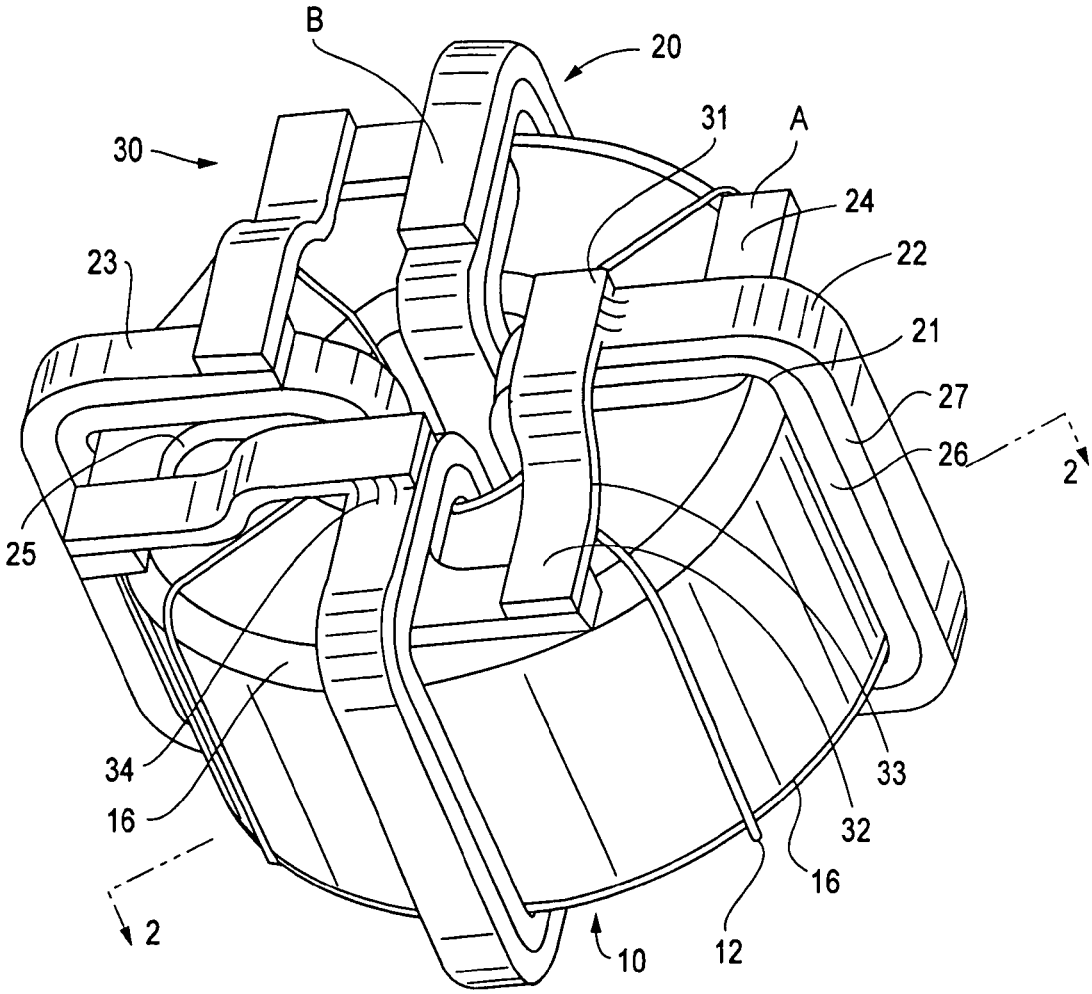
FIG. 1 is a perspective view of the Quad-gapped Toroidal Core of the invention.
Figure 2:
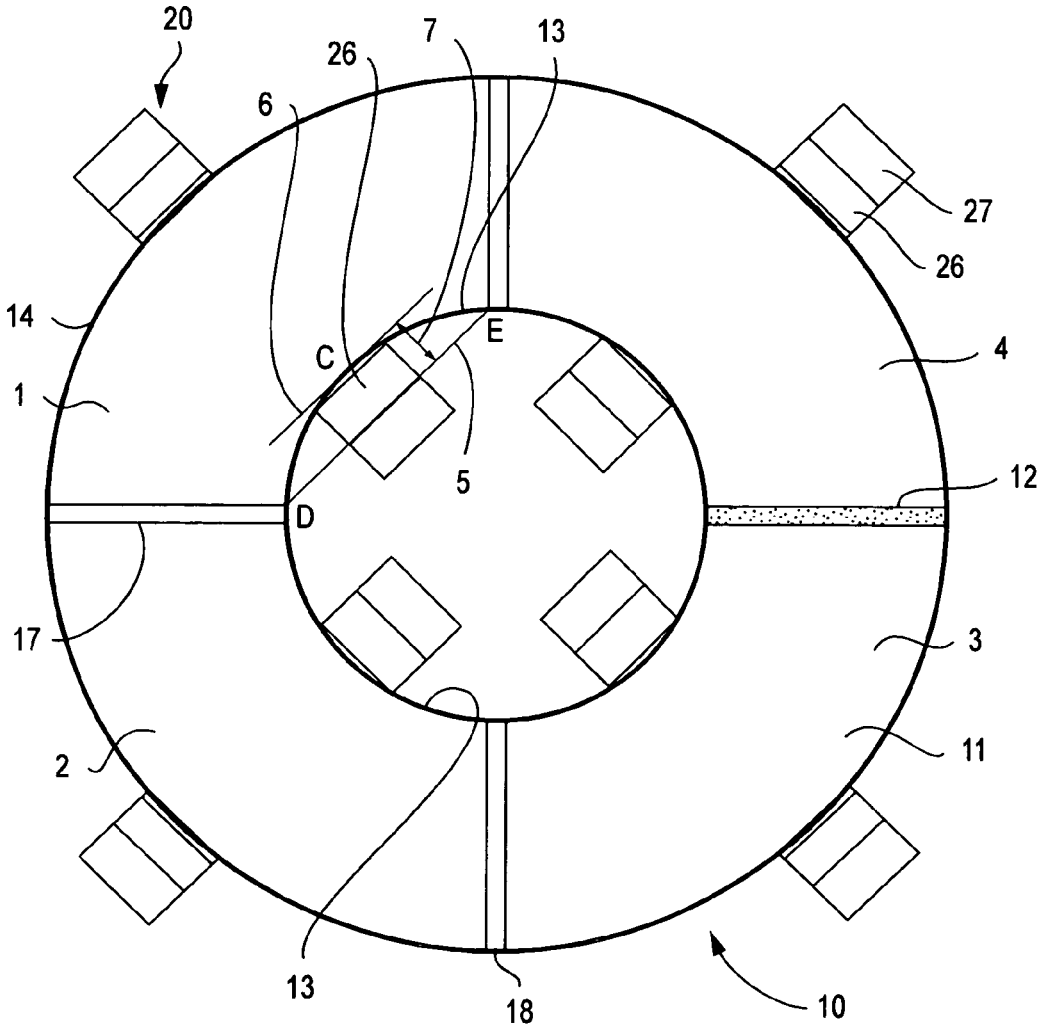
FIG. 2 is a top view of the toroidal core of FIG. 1 along the section lines 2-2 shown in FIG. 1.

The low-loss inductor of the invention is shown in FIGS. 1 and 2. It consists of a toroidal core 10, windings 20, and gaps 18. This inductor can be assembled from a core having 4 quadrants 1,2,3,4, 4 coils 20, and 3 jumpers 30 as well as air gap spacers 12.

Figure 3:
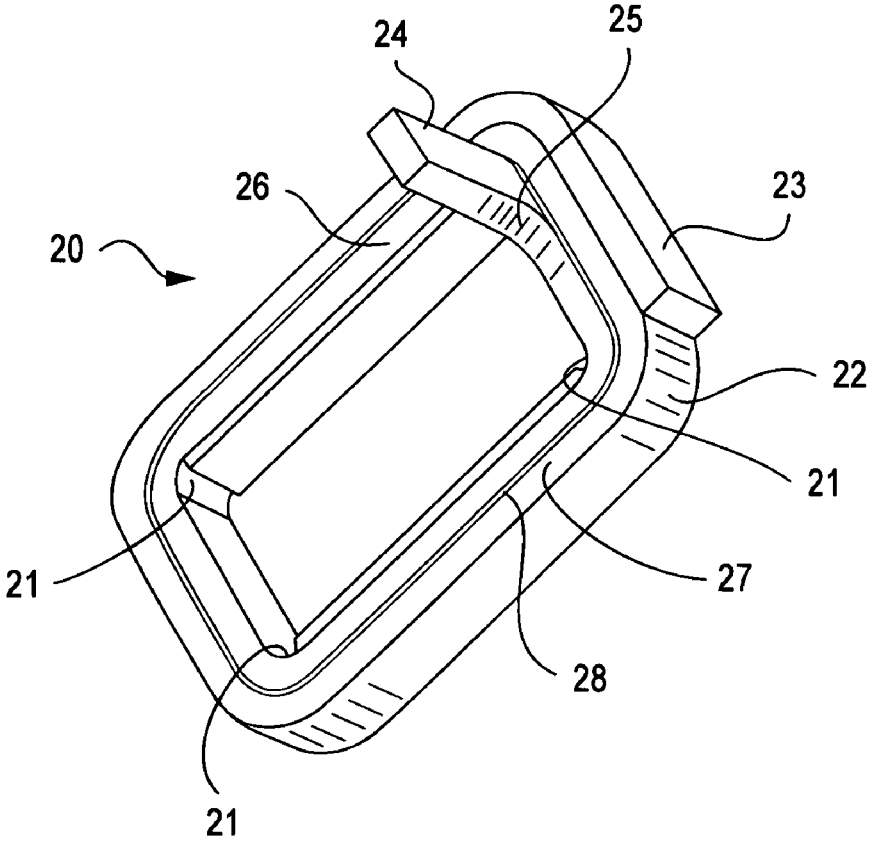
FIG. 3 is a perspective view of a single coil of the invention.

To avoid the difficulties of having large diameter Litz wires or crack-prone magnet wire, this invention uses conductors made of copper wires. The copper wire is designed to carry several hundred amperes. Such wires are typically rectangular in section. Conductors that carry hundreds of amperes of current are thicker and wider. These wires have two primary axes of bending. It is easy to bend along one axis. An easy bend is a bend made in the plane perpendicular to the longest plane or width of the rectangular cross section. It is more difficult to bend perpendicular to the depth or thickness plane. As shown in FIGS. 1 and 3, the winding is made by bending the conductor perpendicular along both the width or widest dimension 22 and depth or thickness dimension 25.

As shown in FIG. 2, the core 10 has an inner diameter surface 13 and an outer diameter surface 14. The inner diameter 13 of the toroidal core 10 is chosen to accommodate the required number of copper turns located at the center or midsection or mean radial section C of the quadrant. Cord DE, joining the corners of the core 1 at the air gaps, and midpoint C enclose one turn 26 of the coil 20. The inner diameter of the core and width of copper turn are proportioned such that at least one turn of the inner winding 26 is "hidden" between the straight line 5 inner end joining the corners of the iron section quadrant, cord DE and the core. If the conductor parallel to the quadrant inner surface carries less current, the thickness of the conductor could be smaller, and more than one turn can be hidden between straight line cord DE and core inner surface 13. This "hidden" copper turn(s) 7 placed between the parallel lines 5,6 or center C and cord DE, protects them from the damaging eddy currents as they are farthest from the fringe gaps. The configuration also uses more than one air gap which allows more energy to be stored. An inductor with 4 air gaps will store more magnetic energy than one with 1 or 2 air gaps. In the preferred embodiment, the core with 4 air gaps will allow the coils to be protected from damaging fringe fields, while increasing the number of turns, thereby increasing inductance.

To make one quadrant core, a complete closed toroidal iron core is fabricated by winding a tape and impregnating it with epoxy resin or using a powder. This closed core's edges or inner 13 and outer 14 radii radial corners are chamfered 15,16 to accommodate the bending radius 21 of the coil. The core is then precisely slit into 4 equal parts. Each quadrant makes an approximately 90 degree arc around the center as can be seen in FIG. 2.

FIG. 3 shows a multi-turn coil winding 21. In a preferred embodiment, it is made from a bare rectangular copper conductor, although other forms such as round or foil can be used. A rectangular sectioned conductor offers a higher copper fill factor and hence reduces the size and weight of the coil. A bare conductor is preferred over pre-insulated magnet wire because the insulation coating on the magnet wire gets damaged during sharp bending.

Figure 4:
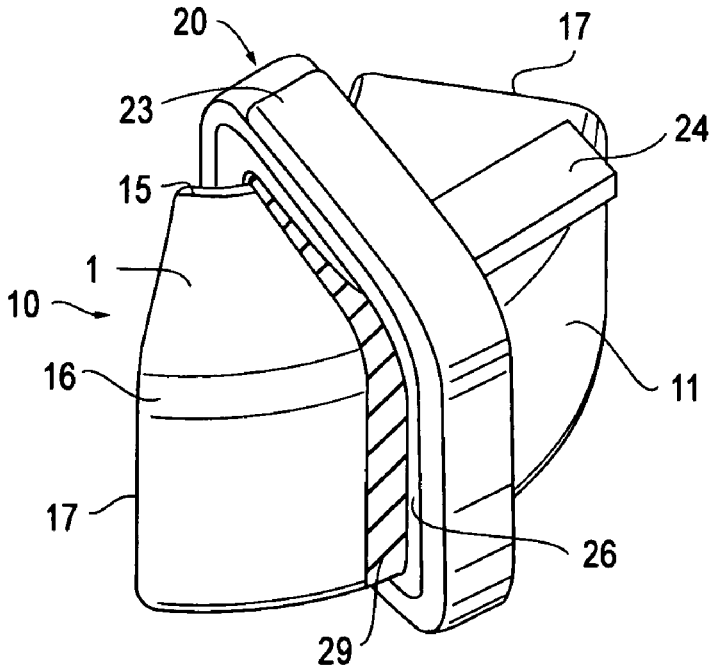
FIG. 4 is a perspective view of one coil positioned on one of the quad cores of the invention.

It is well known that in a single isolated conductor carrying alternating current, the current tends to crowd around the outer periphery of the conductor up to a thickness called skin depth. The conductor skin depth is concentrated near the conductor surface. The circular conductor has the least surface area for a given conductor volume. By increasing the surface area for a given conductor volume or cross sectional area, the conductor skin depth is improved. While other shapes can be used, the rectangle is preferred as it increases surface area for a given volume of conductor material, is easier to work with and, in coil form, gives the lowest profile for conductor width. This configuration enables the greatest amperage with the most coil positioned within the arc formed between the core segment inner diameter and cord DE. This gives the maximum current flow with the minimum fringe loss. In the preferred embodiment, the thickness of the conductor can be chosen to equal twice the skin depth ($2\,\delta$) at the dominant operating frequency. The inner end of the rectangular conductor 26 is first bent 90-degrees 25 in the wide plane, as shown in FIGS. 1, 3 and 4, so that it projects out perpendicular in the width plane of the conductor 24. This coil inner lead is called the tangential lead. It is then bent another 90 degrees 21 in the narrow thickness plane around a core preform. The process is continued to make two or more complete turns 27. The number of turns depends on the inductance required and conductor material and size. In case of high power inductors, this usually varies from 1 to 10 turns. This is in contrast with low power inductors that may have as many as 100 turns as the conductor size required is much smaller.

Insulating paper cut in the form of a strip can be inserted between successive conductor turns to prevent arcing. In this design, one terminal, the tangential lead 24, projects out of the coil plane, while the other outer terminal lead, the radial lead 23, is aligned with the coil windings. This bend-first-and insulate later approach has the advantage that it will eliminate bending stresses within the insulation when it is bent in the width plane. Such stress-free insulation will not degrade as fast as one that is subjected to heavy stress and the inductor will last longer. The wound coil is then varnished or epoxied to protect it against environment deterioration. In an alternative embodiment, one can bend the coil as shown and epoxy or varnish can be impregnated into the air space between successive turns. This approach reduces the cost of making the inductor.

FIG. 4 shows the quadrant/coil subassembly. The coil 20, shown in FIG. 3, is slipped over the core 10 quadrant core 1 ends 17. The air space between the innermost turn 26, parallel to the inner quadrant surface, and the core inner surface is filled with thermally conductive epoxy. This epoxy bonds the coil and core to form a rigid subassembly. It is positioned over the insulation tape 29 on the quadrant core 1. One layer of insulating tape 29, with width slightly larger than the width of the coil and thickness sufficient to prevent arcing between the core and coil, is wrapped in the mid region of each core quadrant. It is positioned over the outer core surface 11 top, bottom, back surface, and chamfers 15,16 such that its mid-section coincides with the mid-section of the quadrant to position the coils farthest from any air gap 18 formed when core quadrant ends 17 are placed together. Positioning the coil far from any gap reduces the fringe loss.

FIG. 1 also shows how quadrant/coil subassemblies are joined together. To join them, a gap spacer 12 is positioned between each quadrant and epoxy is used to bond the quadrants and the spacers together. When bonded properly, the tangential lead 24 of a first coil will be close to the radial lead 23 of a second coil, etc. A jumper 30 is used to connect these two leads together. The jumpers' width may be identical to that of the coil. It is "Z" shaped, and has three portions, the bottom flat portion 32, the top flat portion 31 and the curved central portion 33. The flat portions are at different elevations. The height between the radial lead of one coil and tangential lead of a second coil requires the spacer jumper 30 bottom flat portion 32 and top flat portion 31 to be spaced to span the number of coil turns used. The bottom flat portion 32 under side sits on the top of a tangential lead 24 of a first coil, while the top flat portion 31 under side sits on top of the adjacent radial coil lead, etc. Both ends are soldered 34 by using a high temperature solder. Once the jumper joins both coils, current can flow continuously from a first coil to a second coil. The process is repeated for the other quadrants so that all the coils and quadrants form one complete unit. Three jumpers will be needed to assemble the 4 coils. All parts can be painted black to increase heat loss by radiation. The inductor is joined to an outside circuit by attaching leads to the radial lead 23 at B and the tangential lead 24 at A.

Figure 5:
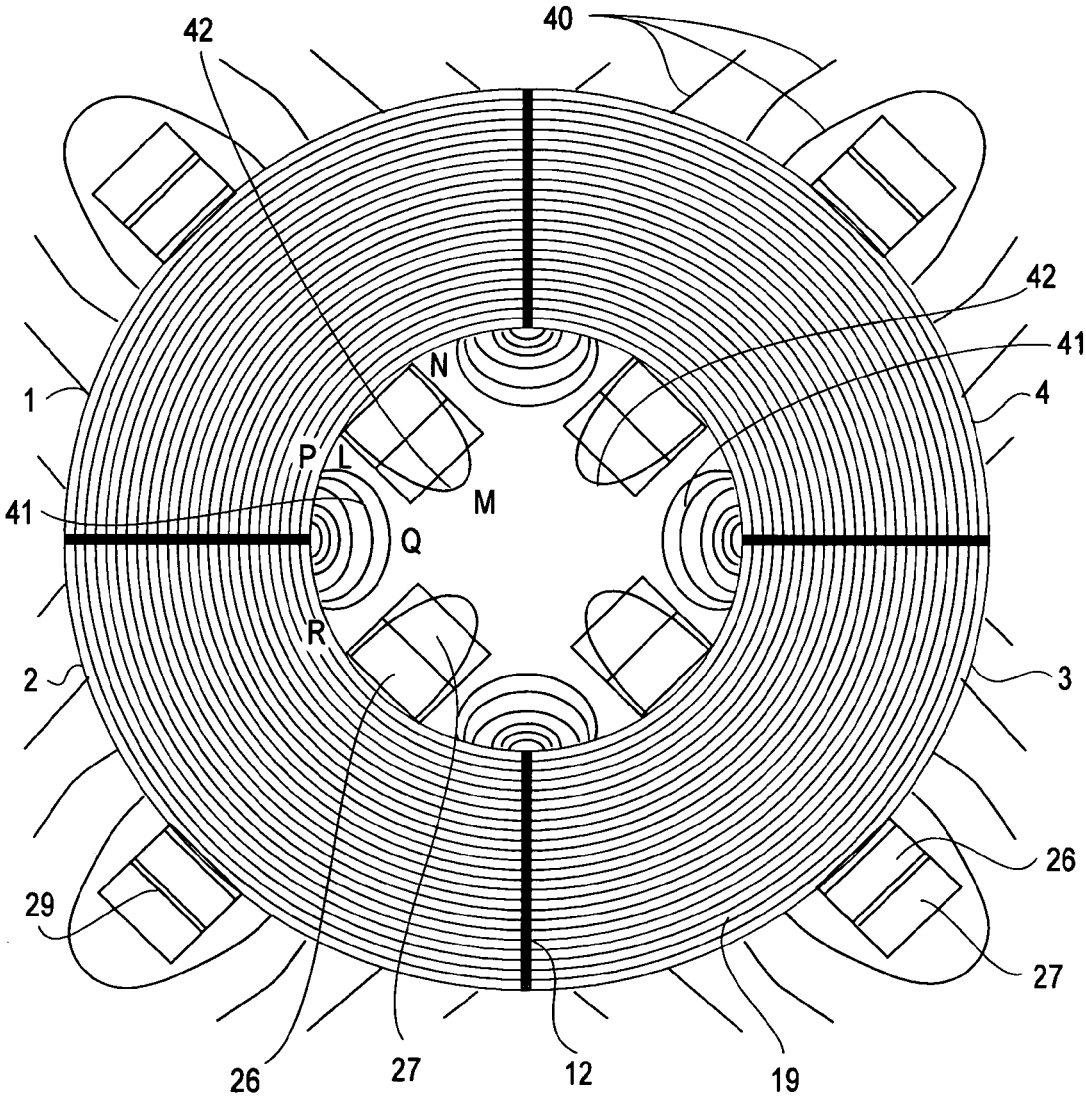
FIG. 5 is a top view of the toroidal core of FIG. 2 showing the flux lines of the invention.

FIG. 5 shows the flux lines 40 that are generated when the coil winding is energized. This figure enables one to understand how the arrangement achieves low loss. It shows that most of the generated flux goes through iron, but some fringe flux leaks from curved iron surfaces through air. The flux that propagates through air can be broadly broken into fringe flux 41 and leakage flux 42. Fringe flux 41, such as PQR, is the flux that originates from one quadrant and jumps into the next quadrant through air surrounding the air gap. Leakage flux 42, such as LMN, originates from one quadrant and jumps back into the same quadrant through the copper coil. Fringe flux, such as PQR, jumps from quadrant to quadrant while leakage flux, such as LMN, jumps within the same quadrant. Ideally both flux lines should not penetrate the copper in order to minimize losses. This figure shows that, when the copper turn is properly sized and positioned, the least amount of flux penetrates the copper conductor. It displays that none of the fringe flux penetrates the copper, so very little fringe loss is created. The fringe flux lines are literally parallel to the conductor's thin edge. There will be only small flux leakage that loops through the copper conductor. The key in sizing and locating the conductor is to ensure that the leakage flux lines 42, LMN, repel the fringe flux lines 41, PQR. When the conductor is arranged in this fashion, very little flux penetrates the copper, thereby reducing eddy current loss.

At low frequencies, the current distribution within the conductor is uniform since little eddy currents are created. At high frequencies the currents in an isolated conductor crowd around its outer surface up to its skin depth. Complex flux interaction is produced by the conductor with other conductors in proximity and out an iron core and produce nonuniform current densities in them.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A toroidal inductor including:

a toroid core split into four quadrants;

one conductor coil over each of said four core quadrants;

three jumpers interconnecting each said conductor coil over each of said four core quadrants to form a toroidal inductor;

each said conductor coil has an inner winding;

each said core quadrant has an inner surface and inner end corners;

each said conductor coil inner winding extends adjacent a core quadrant inner surface, such that said conductor coil inner winding extends between said core quadrant inner surface and a line extending between said core quadrant inner end corners.

2. A toroidal inductor as in claim 1 wherein:

each said conductor coil is located at the midsection of each said core quadrant.

3. A toroidal inductor as in claim 1 wherein:

said conductor coil is formed from a bare rectangular copper wire.

4. A toroidal inductor as in claim 3 wherein:

said rectangular copper wires are wound so that the widest dimension is adjacent and parallel to said core quadrants inner surface.

5. A toroidal inductor as in claim 3 wherein:

said conductor coils are attached to said core quadrants by epoxy.

6. A toroidal inductor as in claim 4 wherein:

each said conductor coil consists of from 1 to 10 rectangular copper wire winding turns.

7. A toroidal inductor as in claim 4 wherein:

each said conductor coil is located at the midsection of each said core quadrant.

8. A toroidal inductor as in claim 6 wherein:

each jumper is "Z" shape with a first flat extension on one end and a second flat extension on a second end, and one arcuate center extension between and joining said first flat extension and said second flat extension;

said second flat extension being elevated higher than said first flat extension, each conductor coil has an inner lead and an outer lead;

each said first flat extension is attached to one inner conductor coil lead and each said second flat extension is attached to one outer conductor coil lead.

9. A toroidal inductor as in claim 1 wherein:

each jumper is "Z" shape with a first flat extension on one end and a second flat extension on a second end, and one arcuate center extension between and joining said first flat extension and said second flat extension;

said second flat extension being elevated higher than said first flat extension.

10. A toroidal inductor as in claim 9 wherein:

each conductor coil has an inner lead and an outer lead;

each said first flat extension is attached to one inner conductor coil lead and each said second flat extension is attached to one outer conductor coil lead.

11. A toroidal inductor as in claim 1 wherein:

said four core quadrants each have flat ends;

each core quadrant is attached to an adjacent core quadrant by epoxy to form a toroid.

* * * * *